US005148795A

United States Patent [19]

Nagai et al.

[11] Patent Number: 5,148,795

[45] Date of Patent: Sep. 22, 1992

[54] APPARATUS FOR CONTROLLING HEATER FOR OXYGEN SENSOR

[75] Inventors: Toshinari Nagai; Hiroshi Tanaka, both of Susono; Makoto Suzuki, Mishima, all of Japan

[73] Assignee: Toyota Jidosha Kabushiki Kaisha, Toyota, Japan

[21] Appl. No.: 773,718

[22] Filed: Oct. 9, 1991

[30] Foreign Application Priority Data

Oct. 12, 1990 [JP] Japan ..... 2-274095

[51] Int. Cl.[5] ..... F02D 41/14

[52] U.S. Cl. ..... 123/697

[58] Field of Search ..... 123/440, 489; 204/425, 204/426

[56] References Cited

U.S. PATENT DOCUMENTS 4,365,604 12/1982 Sone ..... 123/440
4,611,562 9/1986 Nakano et al. ..... 123/440
4,694,809 9/1987 Nakano et al. ..... 123/489
4,911,130 3/1990 Takahashi et al. ..... 123/489
4,938,196 7/1990 Hoshi et al. ..... 123/489
4,947,819 8/1990 Takahashi et al. ..... 123/489
4,993,392 2/1991 Tanaka et al. ..... 123/489
5,067,465 11/1991 Yamasaki et al. ..... 123/489

FOREIGN PATENT DOCUMENTS 0164240 8/1985 Japan .

*Primary Examiner*—Willis R. Wolfe
*Attorney, Agent, or Firm*—Kenyon & Kenyon

[57] ABSTRACT

An apparatus for controlling a heater for an oxygen sensor includes a heater controller for detecting a heater resistance value of a heater and for controlling the heater so that a detected resistance value of the heater is equal to a target resistance value. A specific operating condition detecting unit detects a specific operating condition of the internal combustion engine where the air-fuel ratio is other than a stoichiometric air-fuel ratio. A target resistance value changing unit changes the target resistance value when the air-fuel ratio in the specific operating condition indicated by the sensor output signal is s outside a normal range of air-fuel ratio which should be detected in the specific operating condition.

11 Claims, 13 Drawing Sheets

APPARATUS FOR CONTROLLING HEATER FOR OXYGEN SENSOR

BACKGROUND OF THE INVENTION (1) Field of the Invention

The present invention generally relates to an apparatus for controlling a heater for an oxygen sensor, and more particularly to a heater control apparatus for varying electrical power supplied to a heater provided for an oxide semiconductor type oxygen sensor fastened to an internal combustion engine so that the resistance value of the heater is always equal to a target resistance value.

(2) Description of the Related Art

Recently, various control devices have been developed which are intended to provide an improvement in output power of an internal combustion engine, a reduction of fuel consumption or reduce the amount of undesirable exhaust gas. Normally, such control devices employ oxygen sensors. As is well known, an oxygen sensor is fastened to an exhaust passage of the internal combustion engine and is used to measure the concentration of an oxygen component contained in an exhaust gas. An electronic control type fuel injection device calculates a basic fuel injection time based on the amount of intake air (or negative pressure measured in an air intake pipe) and the revolution speed of the engine, and corrects the basic fuel injection time on the basis of a sensor output signal (voltage) of the oxygen sensor so that a mixture supplied to a combustion chamber is equal to a target air-fuel ratio (for example, a stoichiometric air-fuel ratio).

An oxygen sensor has a sensor element (sense portion) formed of, for example, an oxide semiconductor or a concentration cell. An oxide semiconductor type oxygen sensor includes an oxide semiconductor, such as $TiO_2$ (titania), which has a variable resistance based on the oxygen concentration. A concentration cell type oxygen sensor includes, for example, a zirconia element, which generates a voltage developed across opposite sides thereof when there is an oxygen concentration difference between the opposite sides.

FIG. 1 shows a sensor resistance vs. sensor temperature characteristic of an oxide semiconductor type oxygen sensor, such as a titania oxygen sensor. As shown by curve I, an oxide semiconductor sensor has a low resistance Rr when the oxygen concentration is low, that is, the mixture of air and fuel is rich. On the other hand, as shown by curve II, the oxide semiconductor sensor has a high resistance Rl when the oxygen concentration is high, that is, the mixture of air and fuel is lean. Normally, a change in the resistance of the oxide semiconductor element, labeled, $R_T$, is not directly detected, but detected by using a circuit shown in FIG. 2. In FIG. 2, a resistor $R_O$ is connected to the oxide semiconductor element, and a battery $V_B$ is connected to a series circuit consisting of the resistance component $R_T$ of the oxide semiconductor element and the resistor $R_O$. A change in the resistance $R_T$ of the oxide semiconductor element is detected by measuring a divided voltage (sensor output voltage) $V_{OX}$ developed across the resistor $R_O$. The sensor output voltage $V_{OX}$ obtained when the mixture is rich is greater than that obtained when the mixture is lean.

The sensor output voltage $V_{OX}$ is expressed as follows:

$$V_{OX}=V_B \cdot R_O/(R_O+R_T) \quad (1).$$

Thus, $R_T << R_O$ when the mixture is rich, and thus the following equation is obtained:

$$V_{OX}=V_B \text{ (high (H) level).}$$

On the other hand, when the mixture is lean, $R_T >> R_O$, and thus the following equation is obtained:

$$V_{OX}=0 \text{ (V) (low (L) level).}$$

It is necessary for one side of the zirconia element of the concentration cell type oxygen sensor to always detect a fixed oxygen concentration because the sensor detects the oxygen concentration difference between both sides of the zirconia element. For this purpose, an air intake portion is provided in the concentration cell type oxygen sensor.

Meanwhile, as can be seen from FIG. 1, the resistance $R_T$ of the oxide semiconductor element, such as titania, depends on not only the oxygen concentration but also the temperature of the oxide semiconductor element itself (sensor temperature). Thus, it is necessary to accurately regulate the temperature of the oxygen sensor so that it is equal to an optimal temperature. For the above-mentioned reason, a heater for heating the oxide semiconductor element is provided in the oxygen sensor. Further, based on the fact that the resistance of the heater is associated with the sensor temperature, the energy supplied to the heater is controlled so that the heater resistance is equal to a target resistance value. In this way, the temperature of the oxygen sensor is controlled to an optimal temperature.

In actuality, the heaters of different oxygen sensors have different heater resistance values. Thus, even if the heater resistance value of each heater is equal to the target resistance value, the heater temperatures obtained at this time will be different from each other.

In order to compensate for differences in the heater resistance, the following control apparatus has been proposed in Japanese Laid-Open patent application No. 60-164240. The proposed control apparatus recognizes that the internal combustion engine is cold when the temperature of intake air is equal to the temperature of a coolant for cooling the engine. In this case, the heater has a thermal equivalence with the coolant. Thus, the temperature of the coolant obtained at this time is assumed to be equal to the heater temperature, and the heater resistance obtained at an absolute temperature of zero is calculated.

However, the proposed control apparatus has the following disadvantages arising from a procedure in which the learning of the heater resistance is executed while the engine is operating in a cold start state in order to calculate the heater resistance under conditions as uniform as possible.

If a defective oxygen sensor is replaced by a new oxygen sensor in a warmed-up state of the engine and the engine is started, the learning of the heater resistance may not be executed since the engine temperature has not yet decreased to a temperature obtained in the cold start state. That is, the target resistance value of the old oxygen sensor is still valid although it has been replaced by the new oxygen sensor. Thus, the sensor temperature deviates from an optimal temperature. When an air-fuel ratio feedback control procedure is executed using the new oxygen sensor in the state where the target resistance value of the old one is still valid, the air-fuel ratio calculated by the control procedure deviates from the stoichiometric air-fuel ratio, and nitrogen oxides ($NO_x$), hydrocarbon (HC) or hydrocarbon (HC) will increase.

More specifically, when the heater resistance value of the old oxide semiconductor oxygen sensor is higher than that of the new one, as shown by (1) in FIG. 3(C) the target heater resistance value of the old sensor which is obtained by the learning and is still valid is higher than an optimal value of the new sensor. In this case, as shown by (1) in FIG. 3(B), the sensor temperature is higher than an optimal temperature, and the sensor resistance (the resistance of the oxide semiconductor element) decreases, as can be seen from FIG. 1 and the formula (1). As a result, the air-fuel ratio is controlled so that the mixture becomes lean (L), as shown by (1) in FIG. 3(A). This increases the amount of $NO_x$, and the feedback control procedure fails in the worst case.

Meanwhile, when the heater resistance value of the old oxide semiconductor oxygen sensor is lower than that of the new one, as shown by (2) in FIG. 3(C) the target heater resistance value of the old sensor which is obtained by the learning and which is still valid is lower than the optimal value. In this case, as shown by (2) in FIG. 3(B), the sensor temperature is lower than the optimal temperature, and the sensor resistance increases, as can be seen from FIG. 1 and the formula (1). As a result, the air-fuel ratio is controlled so that the mixture becomes rich (R), as shown by (2) in FIG. 3(A). This increases the amount of HC or CO, and a catalytic smell occurs. It is now noted that FIG. 3 is a graph obtained at an ordinary temperature of 20° C.

As has been described above, the conventional heater control apparatus is capable of compensating for the heater resistance differences in only a very rare operating condition "cold start state". Thus, it is impossible to compensate for heater resistance differences after the engine is started in a state other than the cold start state.

SUMMARY OF THE INVENTION

It is a general object of the present invention to provide an improved apparatus for controlling a heater for an oxygen sensor in which the above-mentioned disadvantages are eliminated.

A more specific object of the present invention is to provide a heater control apparatus capable of more precisely controlling the oxygen sensor even if an engine is started in a state other than the cold start state.

The above-mentioned objects of the present invention are achieved by an apparatus for controlling a heater for an oxygen sensor which is fastened to an exhaust passage of an internal combustion engine, the oxygen sensor having a sensor output signal indicating an air-fuel ratio of a mixture including fuel and air, the oxygen sensor including an oxide semiconductor element having a resistance varying based on a change in a concentration of oxygen in the exhaust passage and including a heater for heating the oxide semiconductor element, the apparatus comprising:

heater control means for detecting a heater resistance value of the heater and for controlling the heater so that a detected resistance value of the heater is equal to a target resistance value;

specific operating condition detecting means for detecting a specific operating condition of the internal combustion engine where the air-fuel ratio is other than a stoichiometric air-fuel ratio; and target resistance value changing means, coupled to the heater control means and the specific operating condition detecting means, for changing the target resistance value when the air-fuel ratio in the specific operating condition indicated by the sensor output signal is outside a normal range of air-fuel ratio which should be detected in the specific operating condition.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 4:
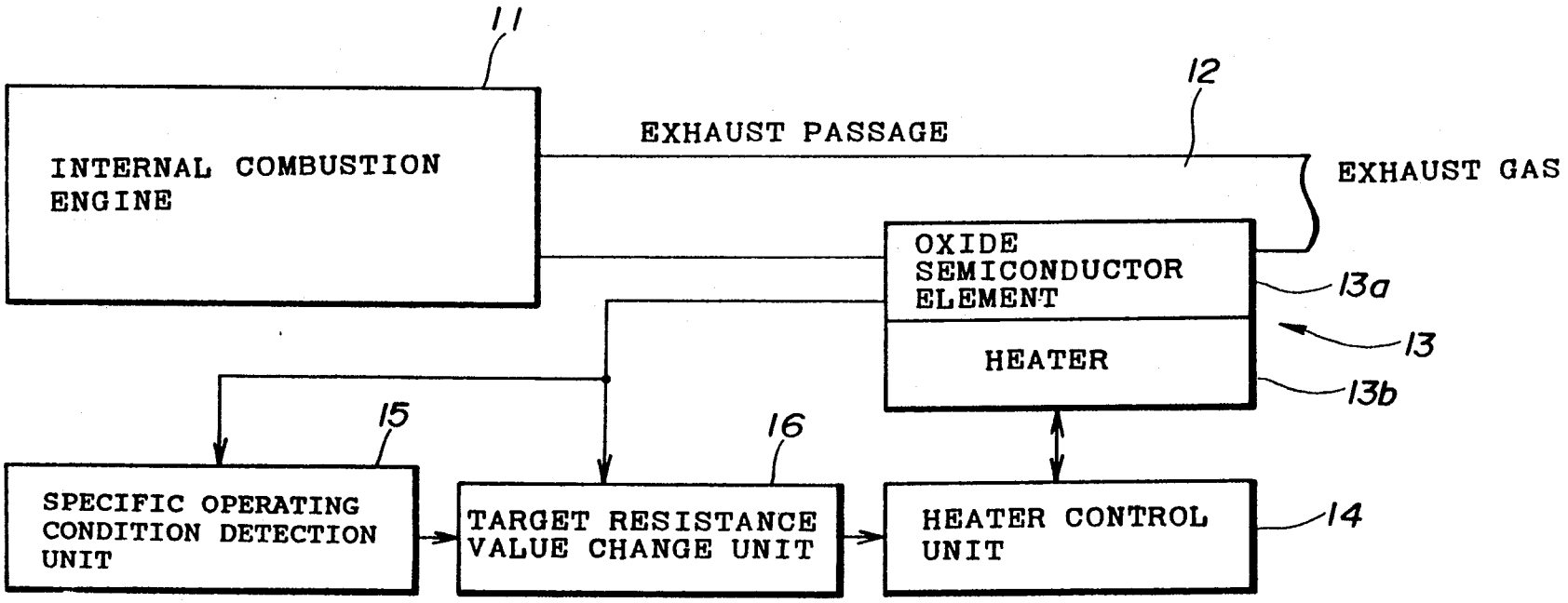
FIG. 4 is a block diagram of an outline of a preferred embodiment of the present invention.

Referring to FIG. 4, a heater control apparatus according to a preferred embodiment of the present invention is comprised of a heater control unit 14, a specific operating condition detecting unit 15, and a target resistance value changing unit 16. An oxygen sensor 13, which is composed of an oxide semiconductor element 13*a*, such as titania, and a heater 13*b*, is fastened to an exhaust passage extending from an internal combustion engine 11. The heater control unit 14 detects the resistance value of the heater 13*b* and controls power supplied thereto so that the detected resistance value is equal to a target resistance value. The specific operating condition detecting unit 15 detects a specific operating condition of the internal combustion engine 11. The specific operating condition is a state where the air-fuel ratio of an intake mixture calculated based on an output voltage of the oxygen sensor 13 (more specifically, the oxide semiconductor element 13*a*) is not equal to a stoichiometric air-fuel ratio. The sensor output voltage shows the resistance value of the oxide semiconductor element 13*a*, which varies depending on the concentration of air in the exhaust passage 12. The target resistance value changing unit 16 changes the target resistance value on the basis of the magnitude (amplitude level) of the sensor output voltage when the sensor output voltage is not at a level corresponding to the original air-fuel ratio.

When the temperature of the oxide semiconductor element (sensor temperature) 13*a* increases, the sensor output voltage is liable to switch to levels showing that the air-fuel ratio is rich. Meanwhile, when the target resistance value used in the heater control unit 14 is too large, the sensor temperature is high. On the other hand, when the target resistance value is too small, the sensor temperature is low.

With the above in mind, the present invention changes the target resistance value on the basis of the level of the sensor output voltage of the oxygen sensor 13 obtained in the specific operating condition (which shows an air-fuel ratio other than the stoichiometric air-fuel ratio). According to the present invention, it is possible to compensate for characteristic differences between oxygen sensors even while the internal combustion engine 11 is operating.

Figure 5:
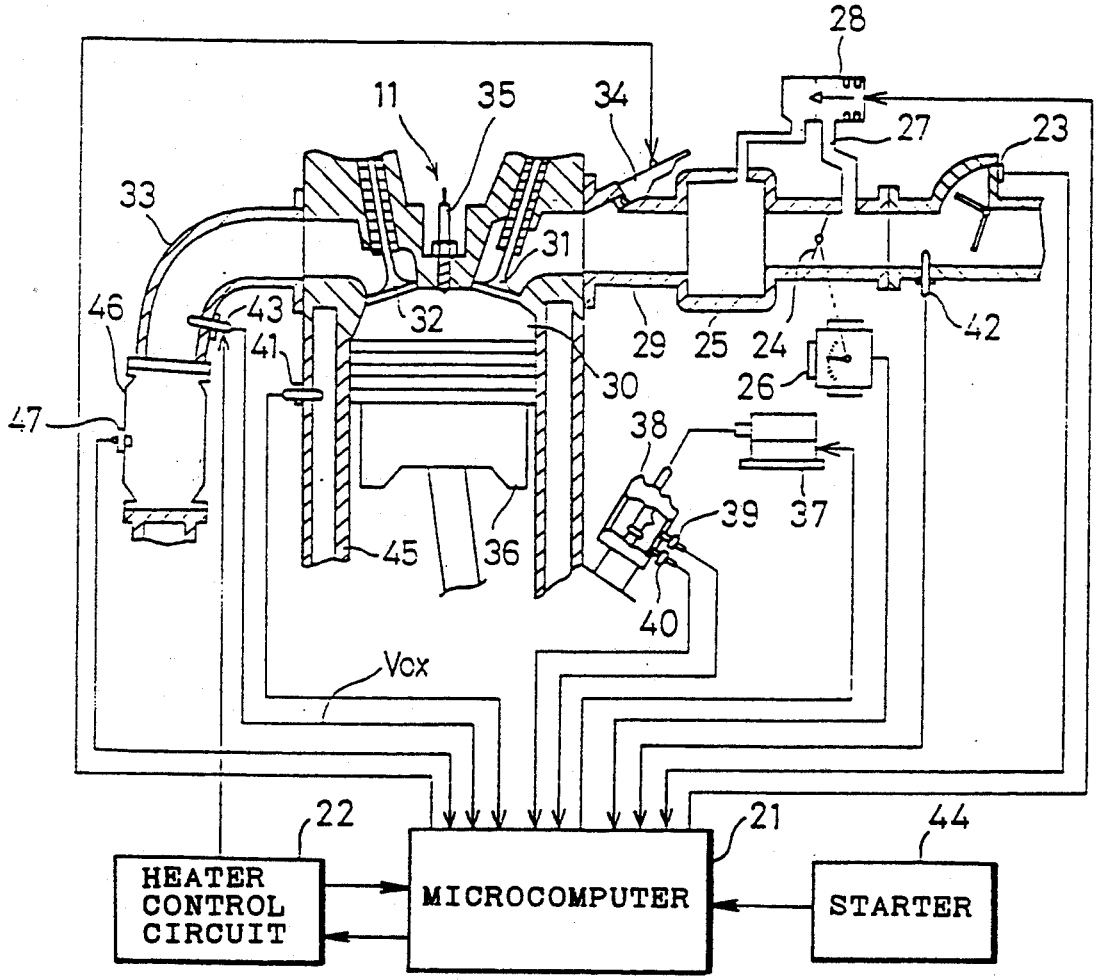
FIG. 5 is a block diagram of the entire structure of the preferred embodiment of the present invention.

FIG. 5 shows the internal combustion engine 11 to which a preferred embodiment of the present invention is applied. The internal combustion engine 11 shown in FIG. 5 is for use in an automobile vehicle. The entire operation of the internal combustion engine 11 shown in FIG. 5 is controlled by a microcomputer 21.

An air flow meter 23 is provided in an intake air passage. A throttle valve 24 is provided on the downstream side of the air flow meter 23. A surge tank 25 is provided on the downstream side of the throttle valve 24. A throttle position sensor 26 is fastened to a throttle body, and detects the motion of the throttle value 24 by means of a plurality of built-in contacts. When the throttle valve 24 is completely closed (that is, positioned at an idle position), an IDL contact of the throttle position sensor 26 is turned ON. A bypass passage 27 bypasses the throttle valve 24 and connects the downstream side of the air flow meter 23 and the surge tank 25 together. An idle speed control valve (ISCV) 28 is provided for the bypass passage 27, and controls the amount of air passing through the bypass passage 27.

The surge tank 25 is coupled to a combustion chamber 30 of the engine via an intake manifold 29. A suction or inlet valve 31 and an exhaust value 32 are provided in the combustion chamber 30, which is coupled to an exhaust manifold 33. A fuel injection valve 34 injects fuel into air passing through the intake manifold 29. An ignition plug 35 is provided so that a part thereof projects in the combustion chamber 30. A piston 36 reciprocates in a cylinder. An ignitor 37 generates a high voltage. A distributor 38 distributes the high voltage generated by the ignitor 37 to plugs 35 mounted on tops of the cylinders.

The engine is provided for various sensors including a cylinder discrimination sensor 38, a turning angle sensor 40, a water temperature sensor 41, an intake air temperature sensor 42, an oxygen sensor 43 with a heater 43*b* (FIG. 6), and a starter 44. Output signals of these sensors are input to the microcomputer 21.

The cylinder discrimination sensor 39 generates a predetermined number of pulses synchronized with the rotation of a shaft of the distributor 38. Such a predetermined number of pulses serves as a cylinder discrimination signal. The turning angle sensor 40 detects the rotation of the shaft of the distributor 38, and measures the revolution of the engine (engine speed). The water temperature sensor 41 is provided so that it penetrates an engine block 45, and partially projects in a water jacket, and measures the temperature of coolant. The intake air sensor 42 measures the temperature of the intake air on the downstream side of the air flow meter 23. The starter 44 detects the fact that the engine is being started (in the cranking state), and outputs a detection signal indicative of the cranking state. The oxygen sensor 43 is disposed so that a part thereof projects in the exhaust manifold 33, and measures the concentration of oxygen contained in the exhaust gas before it enters into a three-way catalyst 46. An exhaust gas temperature sensor 47, which is provided for the three-way catalyst 46, measures the temperature thereof.

The oxygen sensor 43 with the heater 43*b* (FIG. 6) includes, for example, an oxide semiconductor element containing titania ($TiO_2$) in the form of a film on a surface of an insulator base containing alumina, and the heater 43*b* for heating the titania film. The resistance of titania changes in accordance with the concentration of oxygen contained in the exhaust gas which is in contact with the titania film. Thus, it is possible to measure the concentration of oxygen by detecting a change in the resistance value of titania.

Figure 2:
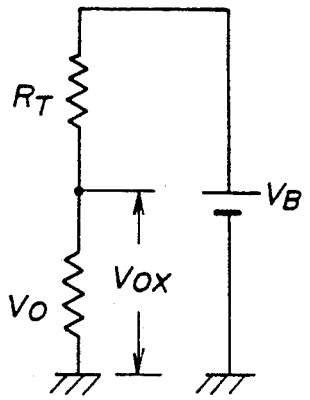
FIG. 2 is a circuit diagram of a circuit configuration for detecting the sensor resistance showing the concentration of oxygen.
Figure 3:
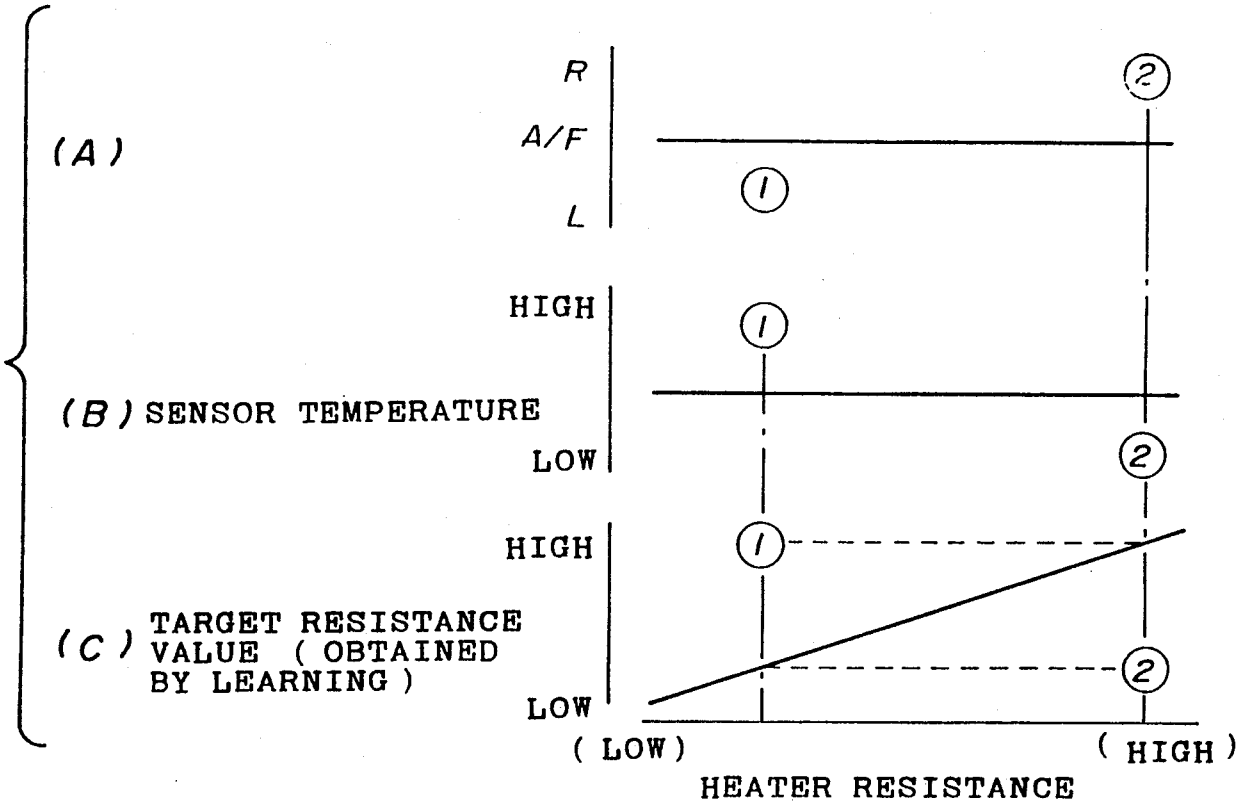
FIG. 3 is a waveform diagram showing disadvantages of a conventional heater control apparatus.

FIG. 2 is an equivalent circuit of the titania oxygen sensor. $R_T$ is the resistance value of the oxide semiconductor oxygen sensor, such as a titania oxygen sensor, which changes a variable resistance based on a change in the oxygen concentration. The aforementioned resistor $R_O$ is connected to the resistance $R_T$ in series, and the battery voltage $V_B$ is applied across the series circuit consisting of the resistors $R_0$ and $R_T$. The sensor output voltage $V_{OX}$ showing the air concentration is developed across the fixed resistor $R_O$.

Figure 6:
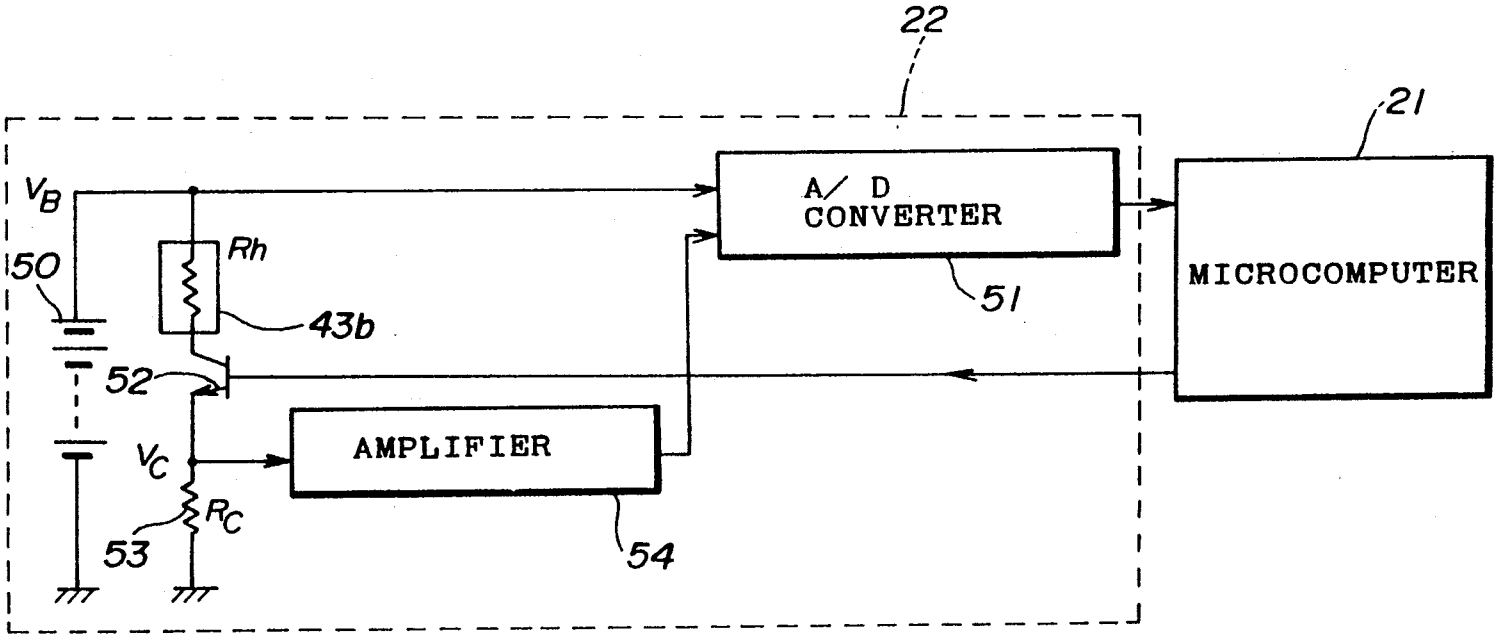
FIG. 6 is a circuit diagram of a heater control circuit used in the preferred embodiment of the present invention.

The power supplied to the heater 43*b* in the oxygen sensor 43 is controlled by a pulse signal generated and output by the heater control circuit 22. FIG. 6 is a circuit diagram of the heater control circuit 22. As shown in FIG. 6, the heater control circuit 22 has a battery 50, an analog-to-digital (A/D) converter 51, a switching transistor 52, a resistor 53 and an amplifier 54. The voltage $V_B$ of the battery 50 is applied to the heater 43*b* provided for the oxygen sensor 43, and converted into a digital signal input to the microcomputer 21 as an operation power supply voltage. The resistance Rh of the heater 43*b* changes based on the temperature of the heater 43*b*. The other end of the heater 43*b* is coupled to one end of the resistor 53 via the collector and emitter of the switching transistor 52. The other end of the resistor 53 is grounded. The resistor 53 has a resistance $R_C$. The amplifier 54 amplifies a voltage $V_C$ obtained at the one end of the resistor 53, and outputs an amplified voltage to the A/D converter 51. A pulse signal generated and output by the microcomputer 21 is applied to the base of the switching transistor 52, so that it is turned ON/OFF and thus the power supplied to the heater 43*b* is controlled.

Figure 7:
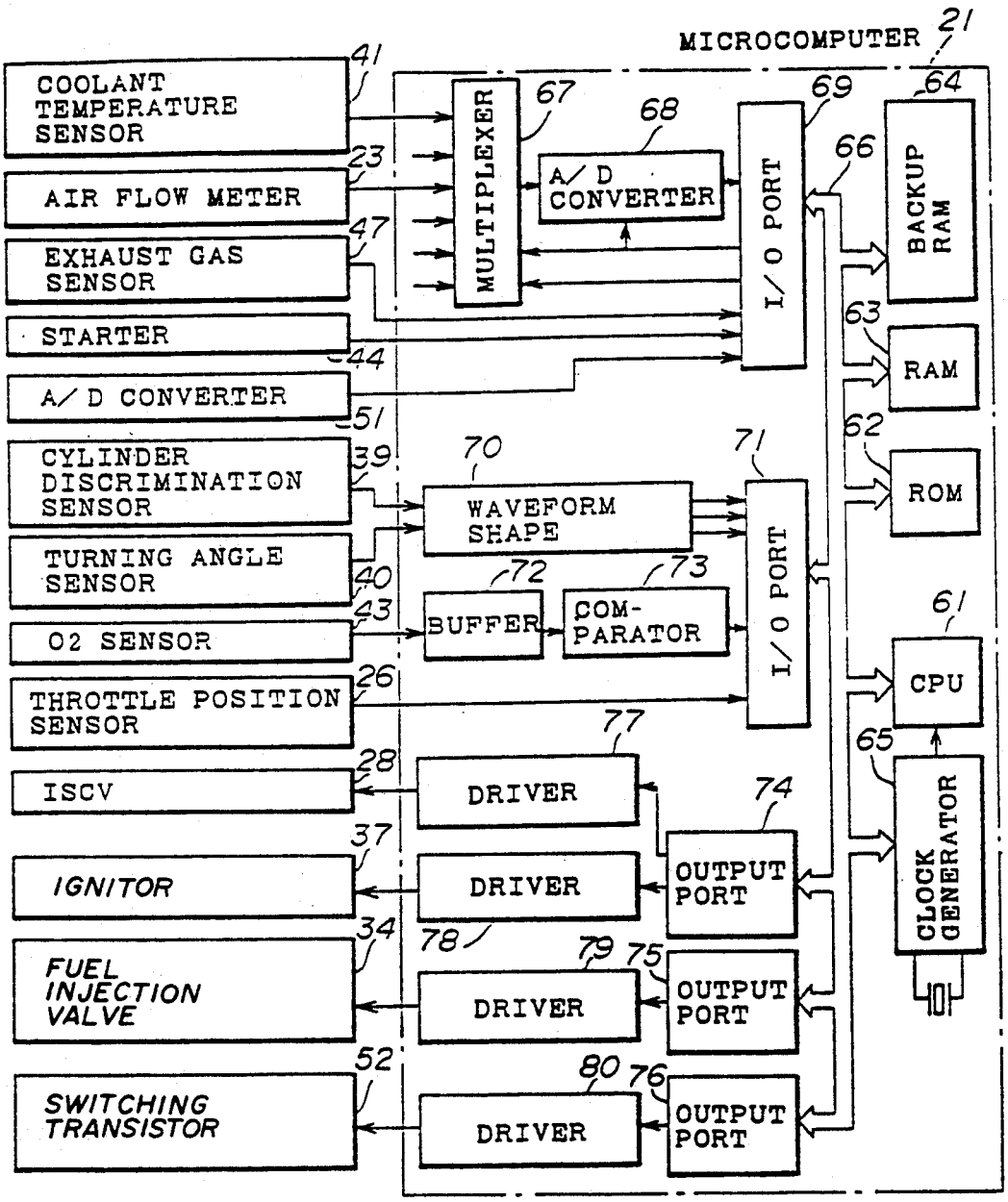
FIG. 7 is a block diagram of an electronic system used in the preferred embodiment of the present invention.

A description will now be given of a hardware structure of the microcomputer 21 with reference to FIG. 7, in which those parts which are the same as those shown in the previously described figures are given the same reference numerals. The microcomputer 21 includes a central processing unit (CPU) 61, a read only memory (ROM) 62, a random access memory (RAM) 63, a backup RAM 64 and a clock generator 65. These structural elements are coupled to each other via a bidirectional bus 66. The CPU 61 controls the entire operation of the microcomputer 21. The ROM 62 stores programs executed by the CPU 61. The RAM 63 is used as a work area of the CPU 61. The backup RAM 64 stores data after the engine is turned OFF. The clock generator 65 generates clocks including a master clock supplied to the CPU 61.

The detection signals from the water temperature sensor 41 and the air flow meter 23 are transferred to the bus line via a multiplexer 67, an A/D converter 68 and an input/output port 69. The detection signals from the starter 44 and the exhaust gas temperature sensor 47 as well as a digital signal from the A/D converter 51 are transferred to the bus 66 via the input/output port 69. The cylinder discrimination signal from the cylinder discrimination sensor 39 and an engine speed signal from the turning angle sensor 40 are transferred to the bus 66 via a waveform shaping circuit 70 and an input-/output port 71. The sensor output signal of the oxygen sensor 43 passes through a buffer 72 and a comparator 73, and is transferred, together with the signal from the throttle position sensor 26, to the bus 66 via the input-/output port 71.

Control signals generated and output by the CPU 61 are input to output ports 74, 75 and 76 via the bus 66. The control signals from the output port 74 are input to driver circuits 77 and 78, and input to the idle speed control valve (ISCV) 28 and the ignitor 37, respectively. The control signal from the output port 75 is supplied to the fuel injection value 34 via the driver circuit 79. The control signal from the output port 76 is supplied to the switching transistor 52 via the driver circuit 80. With the above-mentioned structure, the heater resistance of the titania $O_2$ sensor 43 is varied.

FIG. 8A shows a relationship between the sensor output voltage $V_{OX}$ (FIG. 2) and the target resistance value obtained when the air-fuel mixture is rich. FIG. 8B shows a relationship between the sensor output voltage $V_{OX}$ and the target resistance value obtained when the air-fuel mixture is lean. FIG. 8C shows a relationship between the sensor temperature and the target resistance value obtained by the learning procedure.

Figure 1:
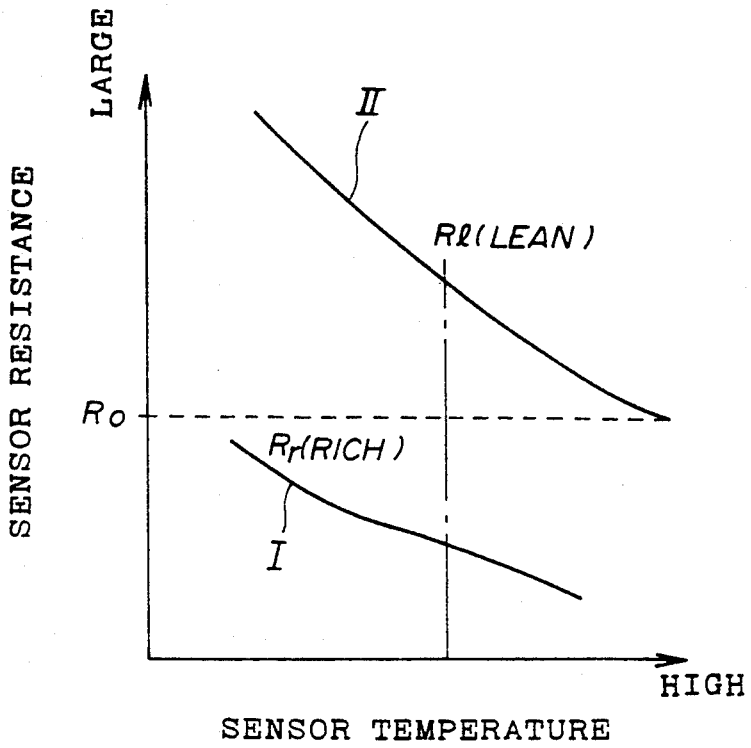
FIG. 1 is a graph of a sensor resistance vs. sensor temperature.

As has been described previously with reference to FIG. 1, the sensor resistance $R_T$ of the titania oxygen sensor 43 decreases as the sensor temperature increases. At a normal temperature at which the titania oxygen sensor is used, the sensor resistance $R_l$ obtained when the mixture is lean is between 100kΩ and 1000kΩ, and the sensor resistance $R_r$ obtained when the mixture is rich is between 100Ω and 1kΩ. In the equivalent circuit shown in FIG. 2, for $V_B=1V$ and $R_O=50k\Omega$, the sensor output voltage $V_{OX}$ obtained when the mixture is rich is determined to be 0.99V by using the aforementioned equation (1) where $R_T=R_r=500\Omega$, if there is no difference between the target resistance value of the heater 43*b* obtained by the learning and the optimal value thereof (normal state). Further, for $V_B=1V$ and $R_O=50k\Omega$, the sensor output voltage $V_{OX}$ obtained when the mixture is lean is determined to be 0.09V by using the aforementioned equation (1) where $R_T=R_r=500k\Omega$, if there is no difference between the target resistance value of the heater 43*b* obtained by the learning procedure and the optimal value (normal state).

Meanwhile, when the target heater resistance obtained by the learning is intentionally decreased to a value (minus side of the graph) smaller than the optimal value, the sensor temperature decreases. As shown in FIG. 8(A), the sensor output voltage $V_{OX}$ obtained when the mixture is rich is equal to 0.91V for $R_T=R_r=5k\Omega$. That is, the sensor output voltage $V_{OX}$ with the mixture rich is lower than that in the normal state. On the other hand, as shown in FIG. 8(B), the sensor output voltage $V_{OX}$ obtained when the mixture is lean is 0.099V, which is slightly greater than that in the normal air-fuel state for $R_T=R_r=5000k\Omega$.

When the target heater resistance obtained by the learning is intentionally increased to a value (plus side) greater than the optimal value, the sensor temperature increases. As shown in FIG. 8(A), the sensor output voltage $V_{OX}$ when the mixture is rich is approximately equal to 1V for $R_T=R_r=50\Omega$. That is, the sensor output voltage $V_{OX}$ when the mixture is rich is approximately equal to that for the normal state. On the other hand, as shown in FIG. 8(B), the sensor output voltage $V_{OX}$ obtained when the mixture is lean is 0.5V, which is very much greater than that in the normal state for $R_T=R_r=5000k\Omega$.

The present invention utilizes the above-mentioned characteristics. According to the present invention, it is determined whether or not the learning of the target heater resistance is correctly executed on the basis of the sensor output voltage $V_{OX}$ obtained when the mixture is rich or lean, and the target resistance value of the heater 43*b* is compensated for on the basis of the results of the determination. A control procedure on the target resistance value of the heater 43*b* according to the present invention is not carried out when the target resistance value is correctly compensated for when the engine is started in the cold starting state. The present control procedure on the target resistance value is executed in a special case, for example, when the oxygen sensor is replaced with a new one.

Figure 9:
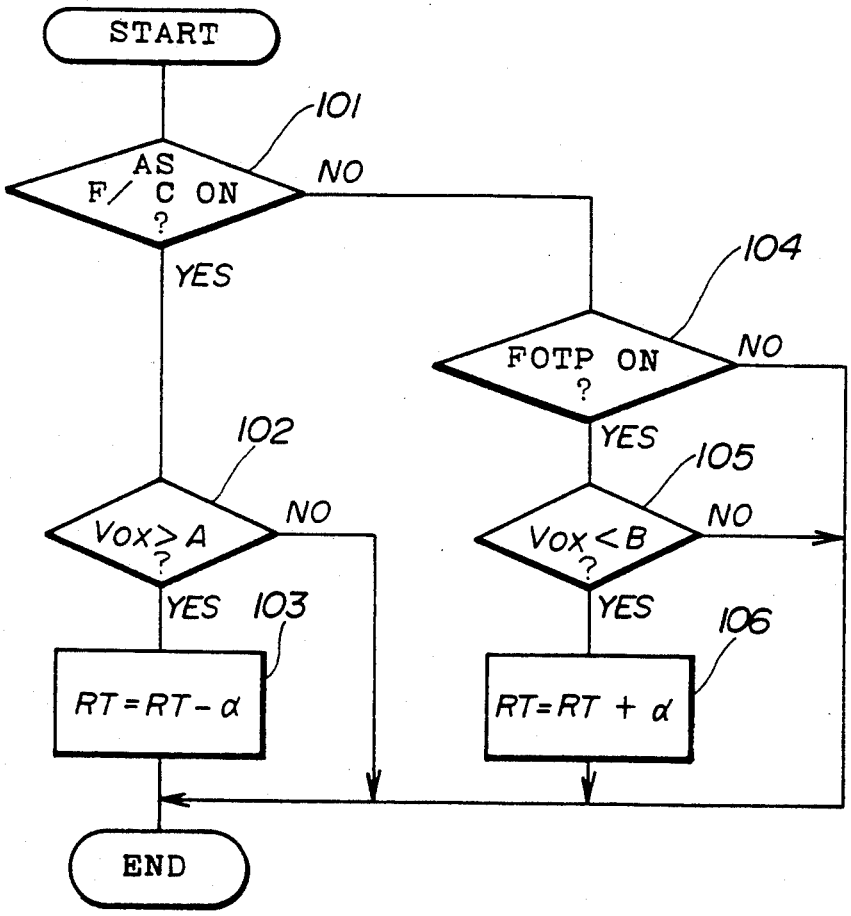
FIG. 9 is a flow chart of a processing routine of an outline of the preferred embodiment of the present invention.

A description will now be given of a target resistance value changing procedure executed under the control of the microcomputer 21 with reference to FIG. 9. The CPU 61 in the microcomputer 21 activates a processing routine shown in FIG. 9 at predetermined intervals. At step 101, the CPU 61 determines whether or not both an air suction (AS) procedure and a fuel cut-off (F/C) procedure are being executed. The CPU 61 manages flags related to the respective procedures, and refers to these flags when executing step 101. The air suction procedure realizes an engine operating condition in which air is introduced into the exhaust passage and HC and CO are reduced by oxidation. The fuel cut-off procedure realizes an engine operating condition where the supply of fuel is stopped when there is no possibility that the engine is stalled in order to improve the fuel economy or realizes an engine operating condition where the supply of fuel is stopped when the revolution speed or vehicle speed becomes greater than a predetermined value in order to suppress an increase in the revolution or vehicle speed. During the above-mentioned engine operating conditions, an air-fuel feedback system is maintained in an open loop state, and the sensor output voltage $V_{OX}$ shows that the air-fuel ratio is lean.

When at least one of the above-mentioned states where the mixture is lean is detected at step 101, the CPU 61 executes step 102, at which step it is determined whether or not the sensor output voltage $V_{OX}$ is greater than a threshold value A (which is, for example, between 0.1V and 0.4V). As has been described previously, when the oxygen sensor having a high heater resistance is replaced with an oxygen sensor having a low heater resistance in the warmed-up engine state, it is determined that $V_{OX}>A$ in the state where the mixture is lean. At this time, as has been shown in FIG. 8(B) and (C), the sensor temperature and the target resistance value $R_T$ of the heater 43*b* are higher than the respective optimal values (abnormal state). The CPU 61 executes at step 103, at which step it decreases the target resistance value $R_T$ by a predetermined value $\alpha$. Then, the CPU 61 terminates the routine shown in FIG. 9. On the other hand, when it is determined, at step 102, that $V_{OX} \leqq A$, the CPU 61 recognizes that the target resistance value does not have any deviation, and terminates the routine shown in FIG. 9.

Meanwhile, it is determined, at step 101, that at least one of the AS procedure and F/C procedure is not being carried out, the CPU 61 executes step 104, at which step it is determined whether or not a heavy load enrichment procedure or a wide open throttle enrichment procedure is being executed. Hereafter, such an enrichment procedure is referred to as an FOTP control procedure. The FOTP control procedure is such that when the internal combustion engine 11 is operating at a high load and/or a high rate of revolution which may damage structural parts of the exhaust system, the mixture is made rich so that the amount of evaporative cooling by the fuel increases and thus the exhaust temperature decreases. When it is determined, at step 104, that the FOTP control procedure is being executed, the CPU 61 executes step 105, at which step it is determined the sensor output voltage $V_{OX}$ is equal to or greater than a threshold value B (which is, for example, 0.6V–0.9V). When the result obtained at step 105 is YES, the CPU 61 recognizes that there is no difference between the target resistance value and the heater resistance value $R_T$ obtained by the learning.

Meanwhile when the oxygen sensor having a low heater resistance value obtained by the learning is replaced with an oxygen sensor having a high resistance in the warmed-up state, the sensor temperature decreases, as shown in FIG. 8(A) and (C). Thus, the sensor output voltage $V_{OX}$ obtained when the mixture is rich during the FOTP control procedure is smaller than the threshold value B. In this case, the result of the step 105 determination shows that $V_{OX}<B$, and the CPU 61 executes step 106, at which step it increases the target resistance value $R_T$ by the predetermined value $\alpha$. Then, the CPU 61 terminates the routine shown in FIG. 9.

Figure 8:
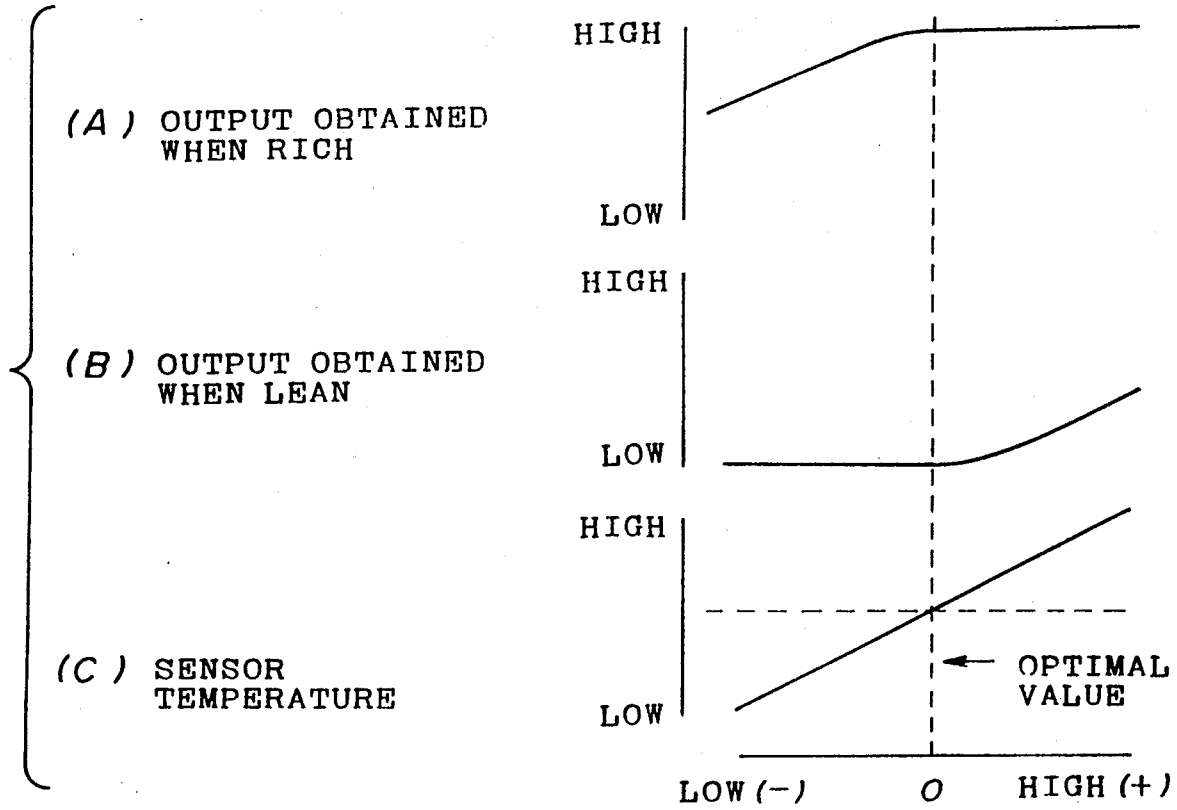
FIG. 8 is a graph showing relationships among a deviation in a target resistance of a heater of a titania oxygen sensor, the temperature and output signal of the sensor.

A further description will now be given of the target resistance value changing procedure with reference to FIGS. 10 through 12. FIG. 8 shows a routine which is executed when the target resistance value $R_T$ is abnormal and higher than the optimal resistance value of the oxygen sensor 43. The CPU 61 executes the routine shown in FIG. 8 every 65 ms. At step 201, the CPU 61 determines whether or not the heater 43*b* of the oxygen sensor 43 is defective by referring to a flag controlled by a diagnostic procedure in a conventional way. When it is determined that the heater 43*b* is operating normally, the CPU 61 determines, at step 202, whether or not the sensor output voltage $V_{OX}$ has changed to a level showing a rich mixture from a level showing a lean mixture. When the result obtained at step 202 is YES, the CPU 61 recognizes that the oxygen sensor 43 has been activated, and determines, at step 203, whether or not a counter value CASON is greater than a predetermined value C (which amounts to 0.1–0.2 seconds).

Step 203 is defined taking into account the following. The sensor output voltage $V_{OX}$ changes to a level indicating a rich mixture with a delay time from the time when the CPU 61 starts to execute the air suction process and increment the counter value CASON in accordance with a procedure shown in FIG. 12. The counter value C corresponds to the above-mentioned delay time.

When the counter value CASON has become greater than the predetermined value C, the CPU 61 determines, at step 204, whether or not the sensor output voltage $V_{OX}$ is greater than the aforementioned threshold value A (equal to, for example, 0.3). Step 204 corresponds to the aforementioned step 102 shown in FIG. 9. When it is determined that $V_{OX}>A$ in the engine operating condition where the mixture is lean, the current sensor temperature is higher than the optimal temperature. Thus, the value in an abnormal state indication counter CTiF is incremented by "1" at step 205, and executes a guard procedure for preventing the counter CTiF from showing a value greater than an upper limit value (that is, the counter is prevented from overflowing). Meanwhile, when it is determined, at step 204, that $V_{OX} \leqq A$, the CPU 61 recognizes that the engine is operating normally, and decrements the value in the counter CTiF by "1" at step 207. At step 206, the CPU 61 executes a guard control procedure for preventing the counter CTiF from showing a value smaller than a lower limit value (that is, the counter is prevented from underflowing).

At step 208, the CPU 61 determines whether or not the value in the counter CTiF is larger than a predetermined value equal to, for example, 3. When the $V_{OX}>A$ state is continuously maintained during a long period longer than 195 ms ($=65$ ms$\times 3$), the CPU 61 executes step 209, which corresponds to the aforementioned step 103 shown in FIG. 9. At step 209, the CPU 61 decreases the target resistance value TR by a predetermined value $\alpha$ (equal to, for example, 01 in hexadecimal notation). At step 210, the CPU 61 executes a guard procedure for preventing the target resistance value $R_T$ from becoming smaller than a lower limit value. Then, the CPU 61 terminates the routine shown in FIG. 10.

Figure 11:
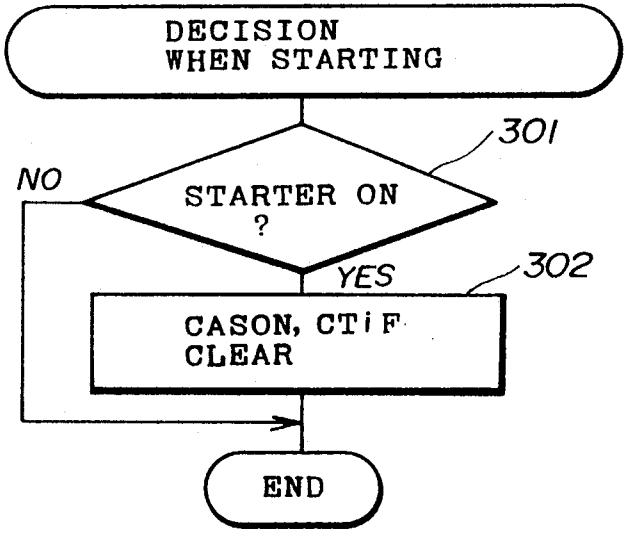
FIG. 11 is a flowchart of an initial setting routine executed in the preferred embodiment of the present invention.

At step 302 of an initial setting routine shown in FIG. 11, the counters CASON and CTiF are cleared when the CPU 61 detects an event that the starter 44 is turned ON at step 301.

Figure 12:
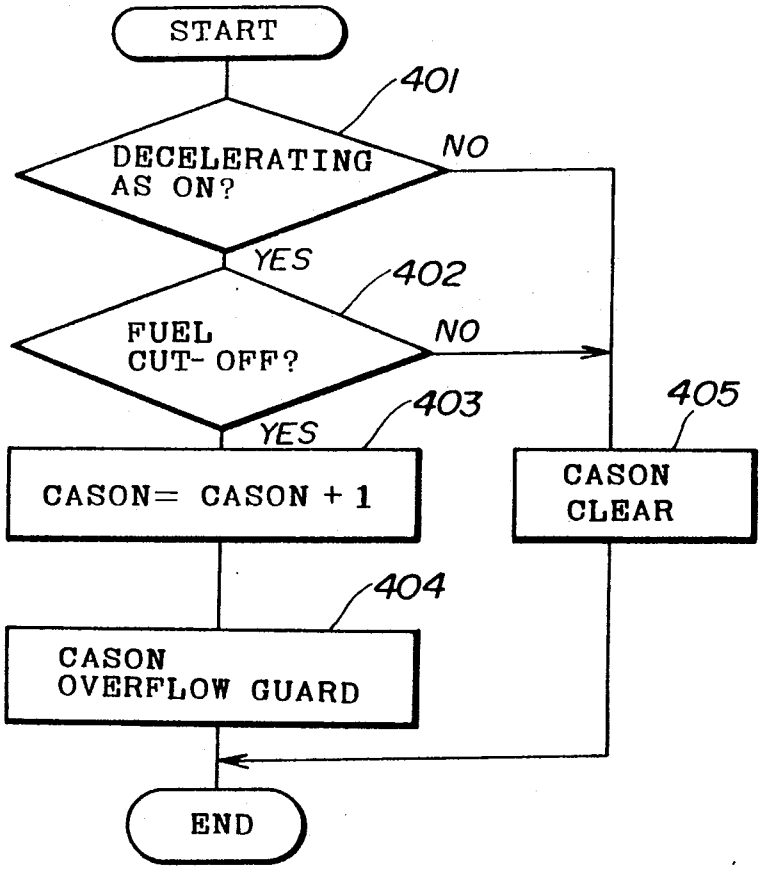
FIG. 12 is a flowchart of a counter value processing routine used in the preferred embodiment of the present invention.

The routine shown in FIG. 12 is activated every 65 ms. At step 401, the CPU 61 determines whether or not the air suction procedure which is executed in the decelerating state is ON. When the result at step 401 is YES, the CPU 61 determines, at step 402, whether or not the fuel cut-off procedure is being executed. When the result obtained at step 402 is YES, the CPU 61 recognizes that the engine is operating while receiving the lean mixture, and increments the value in the counter CASON by "1" at step 403. At subsequent step 404, the CPU 61 executes a guard procedure for preventing the counter CASON from overflowing, that is, exceeding a predetermined upper limit value. Then, the CPU 61 terminates the routine shown in FIG. 12.

Meanwhile, when the result obtained at step 401 or step 402 is NO, the CPU 61 clears the counter CASON at step 405, and ends the routine shown in FIG. 12.

Figure 10:
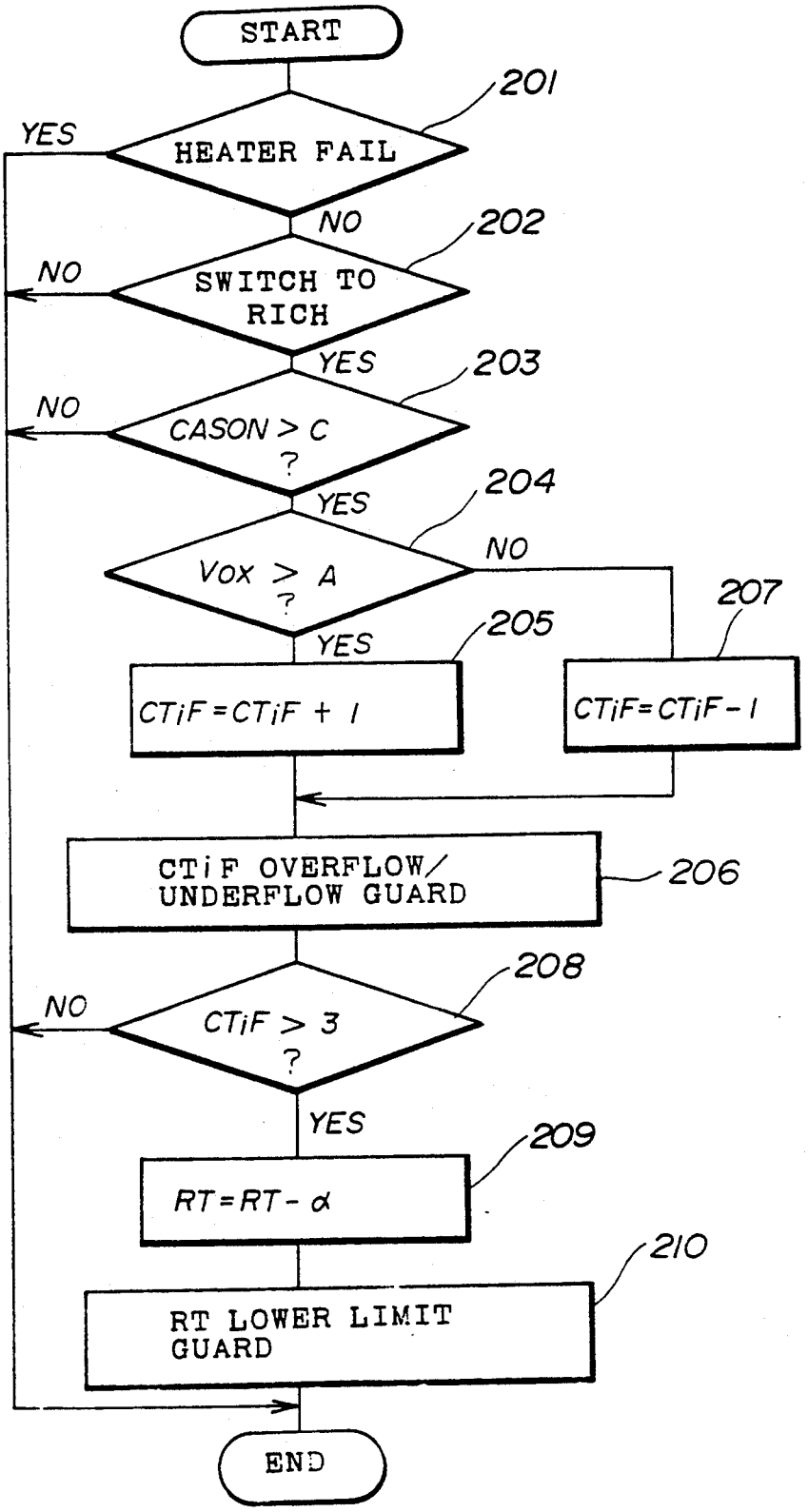
FIG. 10 is a flowchart of a target resistance changing routine executed in the preferred embodiment of the present invention.
Figure 13:
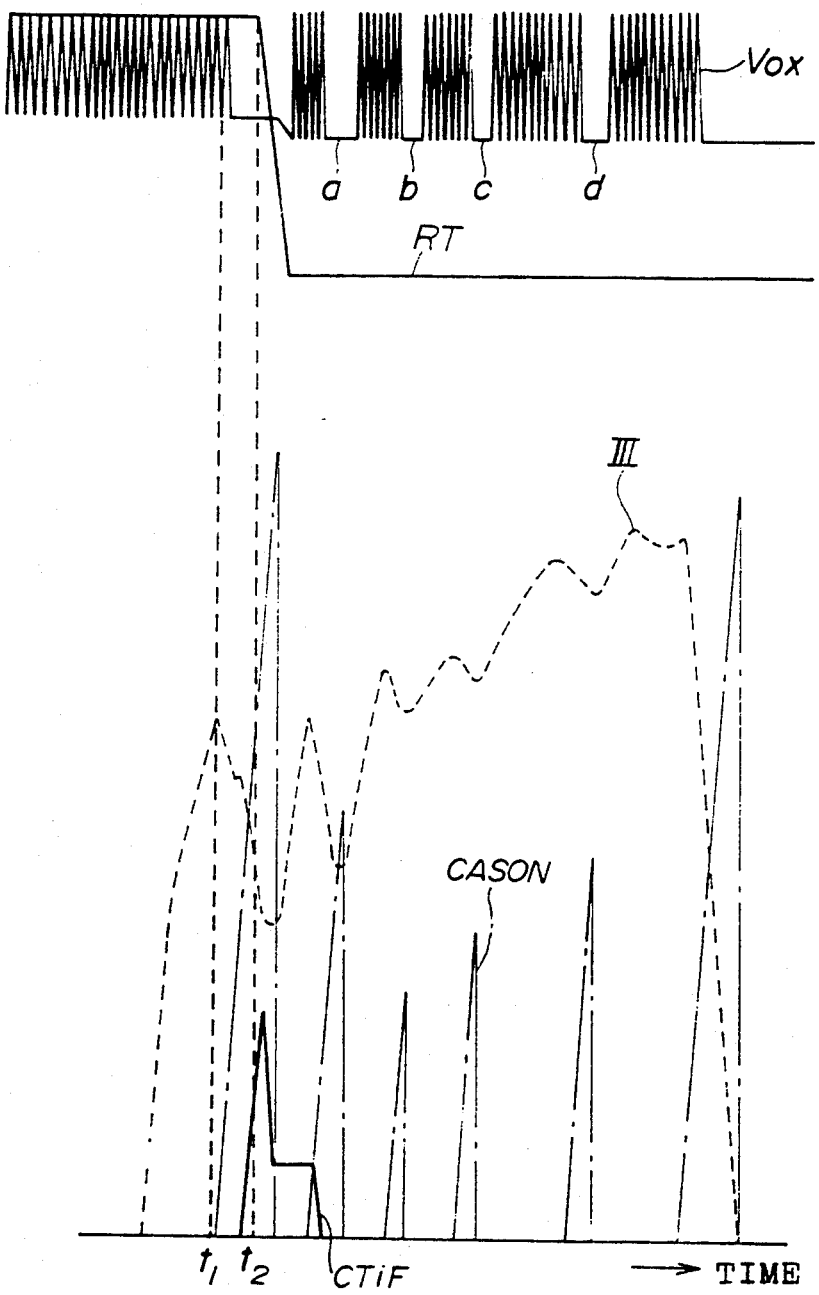
FIG. 13 is a waveform diagram showing changes in parameters during the routine shown in FIG. 12.

FIG. 13 shows the various parameters used during the procedures shown in FIGS. 10 through 12. In FIG. 13, the broken line III shows a change in the vehicle speed, and the one-dot chain line shows a change in the value in the counter CASON. At time $t_1$, both the air suction and fuel cut-off procedures are started. The sensor output voltage $V_{OX}$ obtained when the mixture is lean deviates to a high level while the counter CASON is executing the count-up operation. The target resistance value $R_T$ is decreased by the predetermined value $\alpha$ at time $t_2$ when the value in the abnormal state indication counter CTiF becomes equal to or larger than "3".

Assuming that the target resistance value $R_T$ becomes approximately equal to the optimal value after time $t_2$ when the target resistance value is decreased, the sensor output voltage $V_{OX}$ obtained while the air-fuel mixture is lean has a low level, as indicated by "a", "b", "c" or "d" shown in FIG. 13.

Figure 14A:
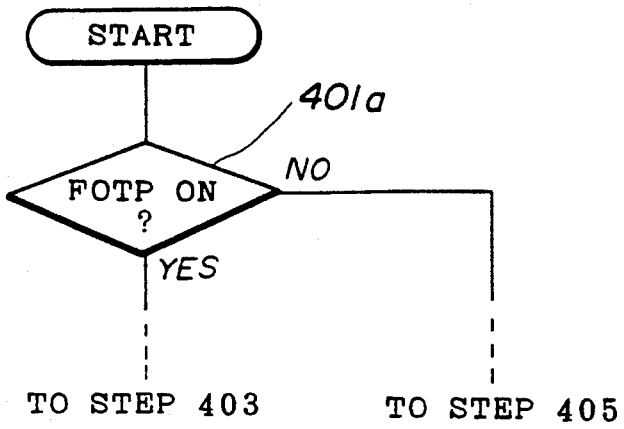
FIGS. 14A and 14B are flowcharts showing steps which are substituted for steps shown in FIGS. 10 and 12.
Figure 14B:
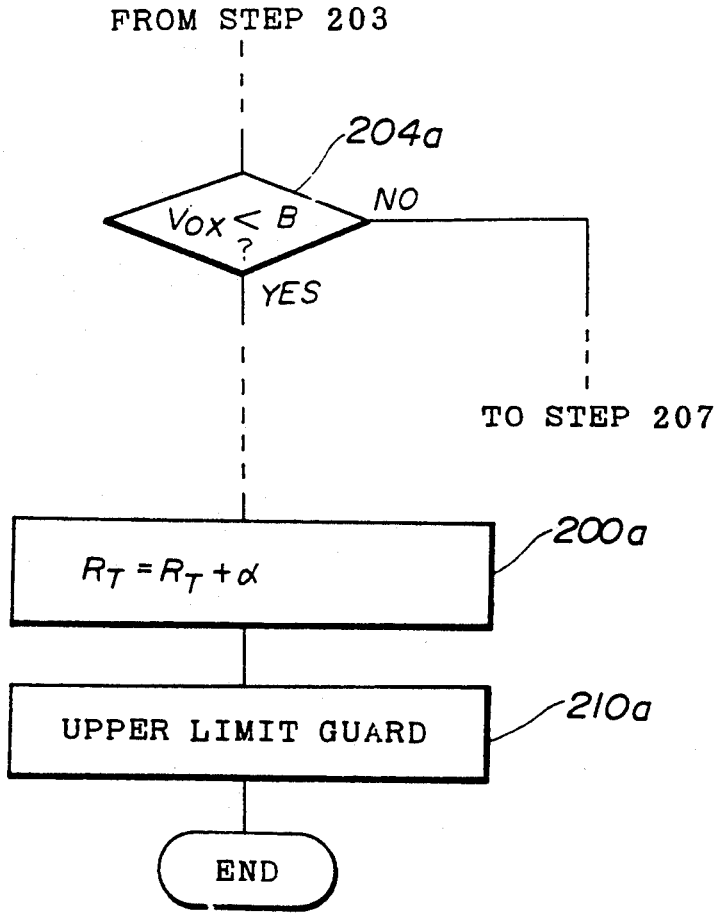

The target resistance value changing procedure can be executed when the engine operating condition where the mixture is rich is detected while the FOTP control procedure or the like is being executed and thus the sensor output voltage $V_{OX}$ becomes lower than the optimal level. In this case, the steps 401 and 402 shown in FIG. 12 are replaced by a single step 401*a* shown in FIG. 14A, at which step it is determined whether or not the FOTP control procedure is being executed. Further, step 204 shown in FIG. 10 is replaced by step 204*a* shown in FIG. 14B, at which step it is determined $V_{OX}<B$. Furthermore, step 209 shown in FIG. 10 is replaced by step 209*b* shown in FIG. 14B, at which step the target resistance value $R_T$ is increased by the predetermined value $\alpha$. Moreover, step 210 shown in FIG. 10 is replaced by step 210*b* shown in FIG. 14B, at which step the target resistance value $R_T$ is prevented from exceeding an upper limit value.

Figure 15:
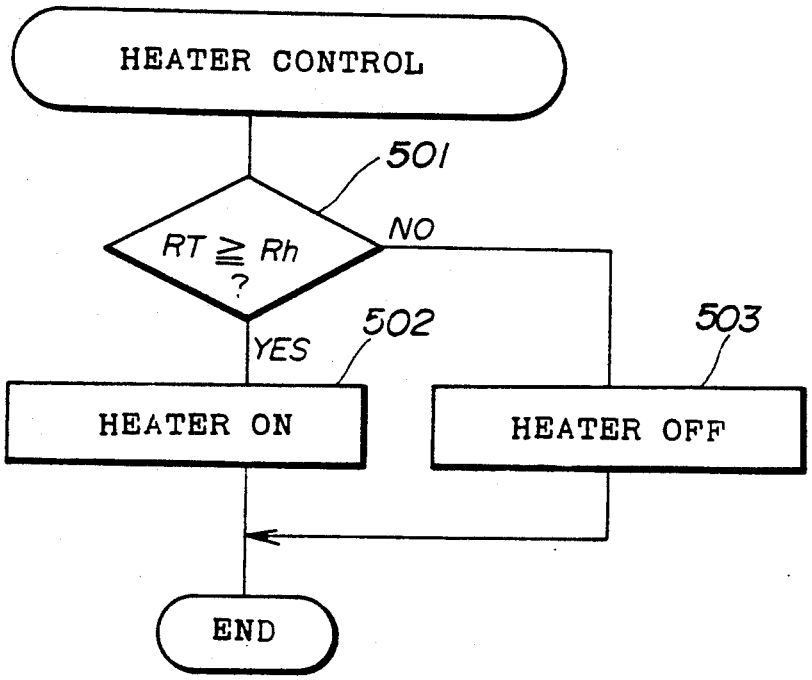
FIG. 15 is a flowchart of a heater control routine executed in the preferred embodiment of the present invention.

A description will now be given of a heater control procedure for controlling the heater resistance value Rh so that it becomes equal to the target resistance value $R_T$ obtained in the above-mentioned way. FIG. 15 is a flowchart of the heater control procedure corresponding to the aforementioned heater control unit 14 shown in FIG. 4. The routine shown in FIG. 15 is executed every 65 ms. At step 501, the CPU 61 measures the heater resistance value Rh, and compares the measured heater resistance value Rh with the target resistance value $R_T$. The heater resistance value Rh is measured as follows. The microcomputer 21 continuously applies a high-level signal to the base of the switching transistor 52 (FIG. 6) for a first few milliseconds of the 65 ms period, so that a current is allowed to pass through the heater 43*b*, the collector and emitter of the switching transistor 52, and the resistor 53. Then, the heater resistance value Rh is calculated using the following formula:

$$Rh=R_C[((V_B/V_C)-1)]$$

where $V_B$ is the battery voltage, and $V_C$ is the voltage developed across the resistor $R_C$ having a known resistance value.

When the heater resistance value Rh is equal to or smaller than the target resistance value $R_T$, the CPU 61 executes step 502, at which step the heater 43*b* is turned ON, and terminates the routine shown in FIG. 15. Thus, when $R_T \geqq Rh$, the switching transistor 52 is continuously kept ON during the rest of the 65 ms period subsequent to the first few milliseconds. Thereby, the current continues to pass through the heater 43*b*, so that it is heated toward a higher temperature.

On the other hand, when the heater resistance value Rh is greater than the target resistance value $R_T$, the CPU 61 executes step 503, at which step the heater 43*b* is turned OFF, and terminates the routine shown in FIG. 15. Thus, the switching transistor 52 is maintained in the OFF state during the rest of the 65 ms period following the aforementioned first few milliseconds, when $R_T<Rh$. Thereby, no current passes through the heater 43*b*, so that the temperature of the heater 43*b* decreases. In the above-mentioned way, the power supplied to the heater 43*b* is controlled so that the resistance Rh of the heater 43*b* is always equal to the target resistance value $R_T$, so that the temperature of the heater 43*b* is fixed.

It is possible to control the switching transistor 52 by a duty ratio control procedure in which the duty ratio of the ON period of the switching transistor 52 to the cycle time is varied.

In the procedures shown in FIGS. 9 through 12, the engine operating condition where the mixture is lean is detected by detecting that both the air suction and fuel cut-off control procedures are ON. It is also possible to detect the engine operating condition where the mixture is lean by determining whether or not one of the two control procedures is ON. It is also possible to employ a procedure in which the peak of the sensor output voltage $V_{OX}$ is compared with a predetermined level and it is determined, on the basis of the results of the above comparison, whether the target resistance value $R_T$ should be changed.

The present invention is not limited to the specifically disclosed embodiments, and variations and modifications may be made without departing from the scope of the present invention.

What is claimed is:

1. An apparatus for controlling a heater for an oxygen sensor which is fastened to an exhaust passage of an internal combustion engine, said oxygen sensor having a sensor output signal indicating an air-fuel ratio of a mixture including fuel and air, said oxygen sensor including an oxide semiconductor element having a resistance varying based on a change in a concentration of oxygen in the exhaust passage and including a heater for heating the oxide semiconductor element, said apparatus comprising:

heater control means for detecting a heater resistance value of said heater and for controlling said heater so that a detected resistance value of said heater is equal to a target resistance value;

specific operating condition detecting means for detecting a specific operating condition of the internal combustion engine where the air-fuel ratio is other than a stoichiometric air-fuel ratio; and target resistance value changing means, coupled to said heater control means and said specific operating condition detecting means, for changing said target resistance value when the air-fuel ratio in the specific operating condition indicated by said sensor output signal is outside a normal range of air-fuel ratio which should be detected in the specific operating condition.

2. An apparatus as claimed in claim 1, wherein the specific operating condition is a condition where the mixture is rich.

3. An apparatus as claimed in claim 1, wherein the specific operating condition is a condition where the mixture is lean or rich, and wherein said target resistance value changing means comprises:

first means for determining whether or not the air-fuel ratio indicated by said sensor output signal shows that the mixture is rich;

second means for decreasing the target resistance value when said first means determines that the air-fuel ratio shows that the mixture is rich;

third means for determining whether or not the air-fuel ratio indicated by said sensor output signal shows that the mixture is lean; and fourth means for increasing the target resistance value when said first means determines that the air-fuel ratio shows that the mixture is lean.

4. An apparatus as claimed in claim 1, wherein the specific operating condition is a condition where the mixture is lean, and wherein said target resistance value changing means comprises:

first means for determining, at predetermined intervals, whether or not the air-fuel ratio indicated by said sensor output signal shows that the mixture is rich;

second means for changing a counter value by a predetermined counter value in a first counting direction each time said first means determines that the air-fuel ratio that the mixture is rich and for changing the counter value by said predetermined counter value in a second counting direction opposite to said first counting direction each time said first means determines that the air-fuel ratio shows that the mixture is not rich; and third means for comparing the counter value of said second means with a reference counter value and for decreasing said target resistance value when the counter value of said second means is greater than said reference counter value.

5. An apparatus as claimed in claim 1, wherein the specific operating condition is a condition where the mixture is rich, and wherein said target resistance value changing means comprises:

first means for determining, at predetermined intervals, whether or not the air-fuel ratio indicated by said sensor output signal shows that the mixture is lean;

second means for changing a counter value by a predetermined counter value in a first counting direction each time said first means determines that the air-fuel ratio that the mixture is lean and for changing the counter value by said predetermined counter value in a second counting direction opposite to said first counting direction each time said first means determines that the air-fuel ratio shows that the mixture is not lean; and third means for comparing the counter value of said second means with a reference counter value and for decreasing said target resistance value when the counter value of said second means is greater than said reference counter value.

6. An apparatus as claimed in claim 1, wherein the specific operating condition is a condition where the mixture is lean.

7. An apparatus as claimed in claim 6, wherein said target resistance value changing means comprises:

first means for determining whether or not the air-fuel ratio indicated by said sensor output signal shows that the mixture is lean; and second means for increasing the target resistance value when said first means determines that the air-fuel ratio shows that the mixture is lean.

8. An apparatus as claimed in claim 6, wherein said specific operating condition is a state where the fuel is continuously cut off.

9. An apparatus as claimed in claim 6, wherein said specific operating condition is a state where air is introduced into the exhaust passage in order to reduce predetermined components in the exhaust passage by oxidation.

10. An apparatus as claimed in claim 6, wherein said target resistance value changing means comprises:

first means for determining whether or not the air-fuel ratio indicated by said sensor output signal shows that the mixture is rich; and second means for decreasing the target resistance value when said first means determines that the air-fuel ratio shows that the mixture is rich.

11. An apparatus as claimed in claim 10, wherein said specific operating condition is a state where an increased amount of fuel is supplied to said internal combustion engine in order to decrease the temperature of the internal combustion engine by evaporating cooling of the fuel.

* * * * *

UNITED STATES PATENT AND TRADEMARK OFFICE

CERTIFICATE OF CORRECTION

PATENT NO. : 5,148,795

DATED : September 22, 1992

INVENTOR(S) : Toshinari NAGAI, et al.

It is certified that error appears in the above-identified patent and that said Letters Patent is hereby corrected as shown below:

Title page, ABSTRACT, line 12, delete "s" between "is" and "outside".

Column 1, line 55, delete the comma after "labeled".

Column 5, line 45, change "value" to --valve--.

Column 5, line 57, change "value 32" to --valve 32--.

Column 10, line 55, change "that" to --in which--.

Column 13, line 32, change "that" to --from--.

Column 14, line 5, change "that" to --from--.

Signed and Sealed this

Twelfth Day of October, 1993

*Attest:*

Bruce Lehman

BRUCE LEHMAN

*Attesting Officer*

*Commissioner of Patents and Trademarks*